United States Patent [19]

Gaschütz

[11] Patent Number: 4,542,772

[45] Date of Patent: Sep. 24, 1985

[54] APPARATUS FOR SELECTIVELY INTRODUCING ONE OR MORE OF A PLURALITY OF DIFFERENT WEFT THREADS INTO AN AIR JET WEAVING MACHINE

[76] Inventor: Heinz Gaschütz, 4773 Möhnesee-Gunne, Kreis Soest, Fed. Rep. of Germany

[21] Appl. No.: 463,994

[22] Filed: Feb. 4, 1983

[30] Foreign Application Priority Data

Feb. 5, 1982 [DE] Fed. Rep. of Germany ..... 3203876

[51] Int. Cl.[4] ..... D03D 47/30

[52] U.S. Cl. ..... 139/435

[58] Field of Search ..... 139/439, 435, 453; 226/97

[56] References Cited

U.S. PATENT DOCUMENTS 3,853,151 12/1974 Donk et al. ..... 139/435
3,863,822 2/1975 Keldany ..... 139/435

FOREIGN PATENT DOCUMENTS

WO80/01392 7/1980 PCT Int'l Appl. ..... 139/435
183135 11/1966 U.S.S.R. ..... 139/435
720069 3/1980 U.S.S.R. ..... 139/435

*Primary Examiner*—Henry S. Jaudon
*Attorney, Agent, or Firm*—Charles R. Rhodes; Judith E. Garmon

[57] ABSTRACT

A single main air jet nozzle includes an outer portion secured to a central body. The central body includes one main orifice which delivers yarn to the main nozzle, and a plurality of weft thread introducing feed orifices. Each feed orifice includes a feed nozzle at the entrance thereto. There is thus provided for the selection of one or more weft threads to be introduced through the introductory or feed nozzles and into the main orifice, and then to the main nozzle from which the yarn is blown into the weaving compartment of an air jet loom. The unselected yarns are held back by a braking or reversing apparatus until selected.

7 Claims, 2 Drawing Figures

APPARATUS FOR SELECTIVELY INTRODUCING ONE OR MORE OF A PLURALITY OF DIFFERENT WEFT THREADS INTO AN AIR JET WEAVING MACHINE

BACKGROUND AND SUMMARY OF THE INVENTION

The present invention is directed to an apparatus for selectively introducing or "blowing in" one or more different weft threads or yarns in an air jet weaving loom. During the weaving of patterns, it is often desirable or necessary to change the color or type of weft yarn being introduced through the weaving compartment. In previously known devices, each of such different types or colors of yarn has been introduced to the weaving compartment through a separate nozzle. The several nozzles are so mounted that the nozzle containing the selected yarn is mechanically moved into the proper position for introducing the yarn into the reed tunnel, which is formed by the U-shaped cross-sectional area of the reeds and extends through the weaving compartment or warp shed. Upon completion of use of the selected yarn, the corresponding nozzle must then be moved out of registration with the reed tunnel and another nozzle moved thereinto. Examples of such apparatuses are described in West German Offenlegungsschrift (publication) No. 3014776 published Nov. 6, 1980, and a Netherlands Octrooiaanvrage No. 7100266 published July 11, 1972. As air jet weaving looms operate at extremely high speeds (four to five hundred picks per minute), it is necessary that the change from one weft yarn to another occur as rapidly as possible. Toward this end, if a mechanical translation of the nozzle is required to effect change of the weft yarn, it can be easily seen that this is disadvantageous since it is time consuming. One improvement already suggested in the earlier mentioned German publication is to mount the individual nozzles with the exhaust openings lying close to one another around a fixed pivot point. This still requires mechanical movement, however, and the additional support parts and timing devices are difficult to accomplish and very expensive.

The present invention, on the other hand, is directed to a unique nozzle construction for selectively introducing one or more weft yarns in air jet looms, which nozzle overcomes the problems set forth above and eliminates all mechanical movement of nozzles. According to the invention, the problem is solved by an apparatus which includes a single, main, stationary nozzle fed by a plurality of introductory or "blow in" nozzles which are mounted in and selectively feed a weft yarn into the main nozzle from which it is transported through the weaving compartment. The nozzle according to the present invention minimizes the moving parts necessary to effect this result. Other than the movement of a breaking or yarn reverse device, there is no movement required. In other words, the movement of one yarn into and out of operative communication with the main nozzle can be made quickly with no mechanical movement of the nozzles. The apparatus according to the present invention can be positioned immediately adjacent the rider beam or may be spaced therefrom as desired.

In summary, the apparatus according to the present invention provides a stationary main nozzle through which one or more of a plurality of yarns are selectively introduced to the weaving compartment. In the main nozzle, the selected thread is guided through an orifice in the central body thereof. Each yarn is introduced through its own stationary introductory nozzle and through an auxiliary orifice to the main nozzle orifice from whence the main air jet blows the yarn through the weaving compartment. When the yarn is to be taken out of operation, it is cut, and a reversing or braking mechanism pulls the yarn back up into the auxiliary orifice from operative engagement with the main nozzle, so that another selected yarn may be introduced thereinto. Further advantages and characteristics will become apparent from reading the following detailed description of the preferred embodiment along with the accompanying drawings in which:

DETAILED DESCRIPTION OF A PREFERRED EMBODIMENT

Figures 1, 2:
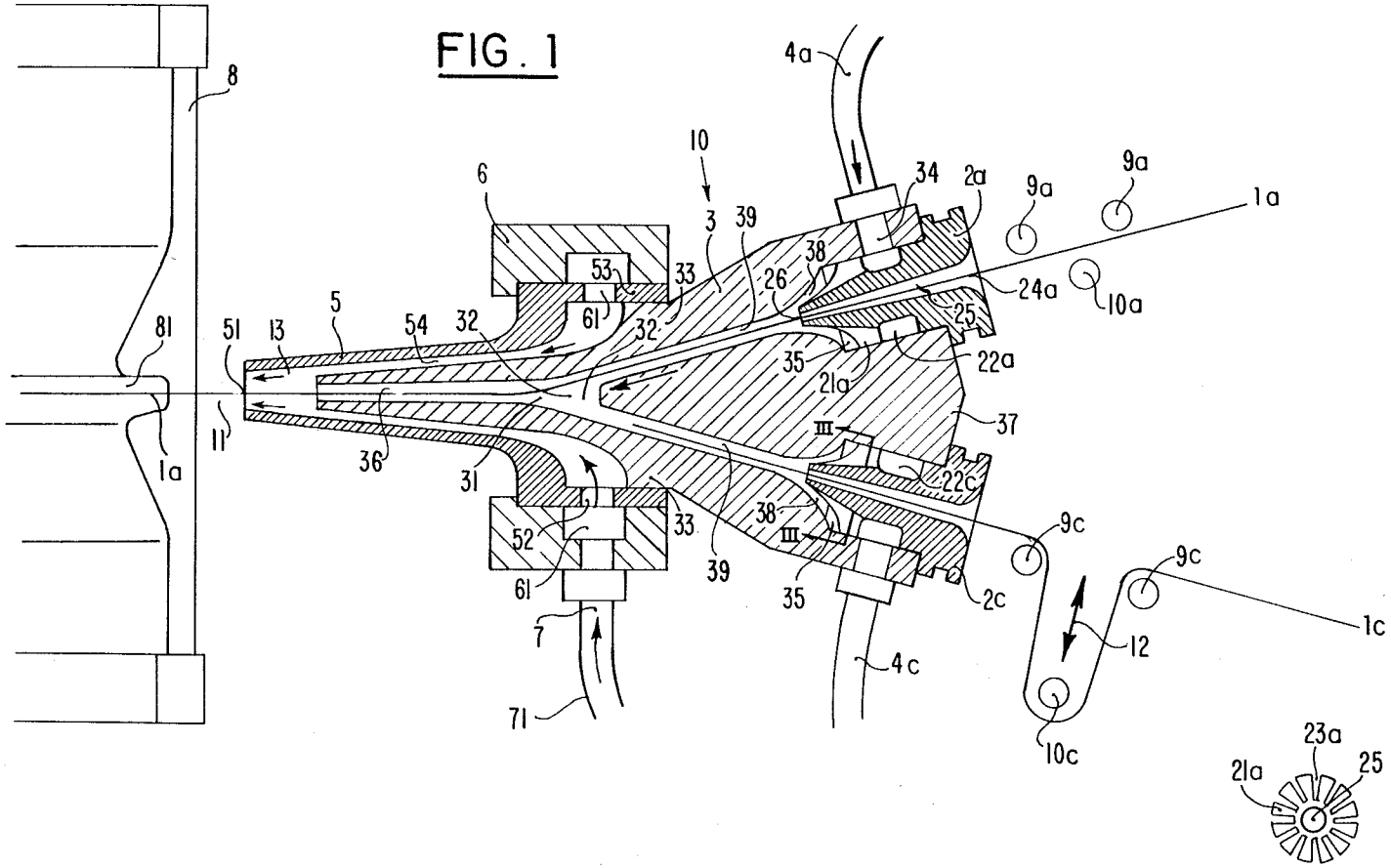
FIG. 1 is a sectional view of the apparatus according to the present invention illustrating a selected yarn being passed through the main nozzle and an unselected yarn being held out of operative engagement therewith.
FIG. 2 is a sectional view taken substantially along lines 3—3 in FIG. 1.

Turning now to FIG. 1, the apparatus according to the present invention is generally designated at 10. It can be clearly seen that a selected weft thread 1*a* is drawn through the apparatus 10 and introduced into the reed tunnel 81. Along this path, the yarn 1*a* passes through the reversing mechanism 9*a*, 10*a* which consists of three rollers, as illustrated in FIG. 1 in the relaxes position. The weft yarn 1*a* then enters an opening 24*a* to an orifice 25 in an introductory or feed nozzle 2*a*. The conical shaped orifice 25 extends through the feed nozzle 2*a* and leads to an outlet 26 at the opposite end thereof from the opening 24*a*. The weft yarn 1*a* then is received and passes through one of a plurality of auxiliary orifices 39 in the central body member 3 to a common central chamber 32. The yarn 1*a* then enters a common delivery orifice 31 which extends from central chamber 32 substantially in a straight line until it passes out through an opening 36 in formed the main nozzle. Air from an air source is introduced into the main nozzle 13 through an outer portion 5 where it causes, by the Venturi effect, the drawing of the yarn 1*a* through and out the exhaust opening 51 from which it is introduced into the reed tunnel. There is a short space 11 between the outlet 51 of the main nozzle 13 and the weaving compartment where a weft thread cutting device, such as scissors or the like (not shown) are provided. In the weaving compartment, the yarn 1*a* passes through the reed tunnel 81 formed by the individual plates of the loom reed 8.

Looking more closely at the individual elements of the apparatus, the main nozzle 13 includes an outer portion 5 moving a rearward end 53 which is secured to the central body 3 by a draw ring 6. A ring channel or manifold 61 is provided in the inner wall of draw ring 6 and extends around the rear portion of outer portion 5. A supply of air from a source of compressed air is provided through a hose 71 and through an opening in the draw ring 6 to the manifold 61. The air then passes from manifold 61 through the openings 52 in the rear portion of outer portion 5 and travels through channels 54 as shown by the arrows in FIG. 1.

The central body member 3 includes an annular seat or collar 33 on the outer wall thereof which receives the rear edge 53 of the outer portion 5 of the main nozzle 13, and is securely seated thereon in sealed arrangement by draw ring 6. The central body member 3 then expands rearwardly in a funnel shape and forms on the inside a common central chamber 32, which lies in front of the central nose piece 37. The central body member 3, as illustrated in FIG. 1, includes four cone-shaped recesses 35 arranged therein to receive the feed nozzles 2*a* -2*d* leading to the auxiliary orifices 39. It is to be recognized that because FIG. 1 is a in the cross-sectional view, only feed nozzles 2*a* and 2*c* are shown, and nozzles 2*b* and 2*d* are not illustrated. Toward the rear edge of central body member 3, there is provided an opening 34 through the wall thereof in communication with each groove 22 to provide a passageway for air from a compressed air supply through holes 4*a*-4*d*. Thus, each of the feed nozzles 2*a*-2*d* are provided with compressed air through hoses 4*a*-4*d* and are operated by valves working in cooperation with the weft yarn selection apparatus (not shown).

In the other wall of each feed nozzle 2*a*-2*d* adjacent each opening 34 there is a circular groove 22*a*-22*d*. Forwardly of the circular grooves 22, each feed nozzle 2*a*-2*d* includes a series of projections 21*a*-21*d* (FIG. 3) which abutt the inner wall of the recess 35 in sealed arrangement and form a side of the grooves 22. The projections 21*a*-12*d* include radial-shaped milled grooves 23*a*-23*d* as shown in FIG. 3. Each feed nozzle 2*a*-2*d* has a conical-shaped forward end corresponding in shape to the adjacent wall forming the recess 35. The projections are spaced from each other and with the wall of recess 35 form a guide channel 38 for the air stream to guide the air stream in a suitable manner to transport the respective weft threads 1*a*-1*d* as they leave the feed nozzles 2*a*-2*d* and enter the orifices in the central body member 3. Again, it should be evident that the construction and manner of operation of introductory feed nozzles 2*a*-2*d* cause a draw in of the weft yarns 1*a*-1*d* into the central body member by means of the Venturi effect.

The reversing or braking means for each weft thread consists of a pair of fixed rollers 9*a* lying in spaced arrangement and a movable roller 10*a* on the opposite side of the yarn in a position intermediate the two fixed rollers 9*a*. As illustrated, the roller 10*a* is withdrawn, so that it does not engage or influence at all the movement of the weft yarn 1*a*. Looking, however, at the roller 10*c* and its associated fixed rollers 9*c*, it is evident that by moving the roller 10*c* to its extended position, in a well-known manner, the reversing mechanism has pulled the weft yarn 1*c* rearwardly and holds it there. Once the weft yarn 1*c* is cut, and the air supply thereto withdrawn, operation of the movable roller 10*c* withdraws the yarn 1*c* back out of operation with the main nozzle. Therefore, the yarn 1*c* does not reach to the chamber 32 and will not be drawn through the main nozzle.

As illustrated the arrangement of the feed nozzles 2*a*-2*d* is for illustration where four colors of yarn are being used. Preferably the nozzles 2*a*-2*d* are arranged around the periphery of a circle approximately 90° apart. It should be recognized, however, that the device according to the present invention can also be laid out for more or less colors or yarns, so that use of four nozzles is illustrative only.

The apparatus 10 according to the present invention may be stationarily positioned at or adjacent one end of the loom reed 8 at a point in the cycle where the loom reed is stationary during the weft draw in. Alternatively, the apparatus 10 can be synchronized to move with the loom reed if the draw-in movement and movement of the loom reed 8 requires such.

At the initiation of each pick or movement of the weft yarn, the main nozzle is provided with air through the pipeline 71. Simultaneously, one or more of the feed nozzles 2*a*-2*d* is provided with air, the nozzle so provided corresponding with the weft thread or threads 1 which is intended to be projected across the weaving compartment. The remaining threads are held back by the braking or reversing mechanisms 9,10, and are so retained in such position until it is time for these yarns to be introduced to the fabric. The weft threads 1*a*-1*d* are retained in storage reservoirs or racks in a well known manner and fed to the appropriate feed nozzle 2*a*-2*d* by a system of well known guides and rollers (not shown).

The choice of the weft thread to be used at any particular moment, and thus the operation of the valves leading to the air hoses 4*a*-4*d*, as well as the operation of the braking or drawback mechanisms 9,10 can be operated initially by any well known device, such as cams from the main shaft of the machine, or tapes, or the like.

As described hereinabove, it is possible to introduce two yarns into the main nozzle 13 by appropriate control of the valves from the auxiliary air supply through hoses 4*a*-4*d* and by operation of the appropriate reversing or braking mechanisms 9,10. When this occurs, obviously two valves are opened and two braking mechanisms are released simultaneously. This provides a double weft yarn being fed through the weaving compartment, whether such yarns are of different colors or of the same color.

In FIG. 1, there is illustrated a loom reed 8 with a reed tunnel 81 through which the weft yarn is normally introduced. The construction of the loom reed, is however, independent of the present invention and other well known loom reed constructions can be utilized, as the present invention is directed only to the manner in which the yarns are selected and fed.

While a preferred embodiment of the present invention described in detail hereinabove, it is apparent that various changes and modifications might be made without departing from the scope of the present invention which is set forth in the claims below.

What is claimed is:

1. Apparatus for selectively introducing one or more of a plurality of weft threads to the weaving compartment of an air jet loom comprising a single main air nozzle including an outer portion secured to a central body, a common central air chamber within said central body, and a delivery orifice extending from said central chamber for delivery of yarn from said central chamber to said main nozzle; said central body having a plurality of auxiliary orifices leading to said central chamber; means for supplying air under pressure to the exhaust opening of said main nozzle to draw a selected yarn therethrough; a plurality of feed nozzles each of which is mounted in operative communication with one of said plurality of auxiliary orifices; means for supplying air under pressure to a selected one of said feed nozzles to deliver a selected yarn therethrough; and a reversing means associated with each of said yarns for withdrawing the unselected yarns from said orifice.

2. The apparatus according to claim 1 wherein the outer portion of said main nozzle includes a plurality of radially drilled holes around the periphery thereof providing communication from the outside to the outlet of said delivery orifice, and a support ring surrounding at least the portion of said outer member containing said radially drilled holes, said support ring including a channel therein overlying each of said holes and connected to said source of air pressure.

3. Apparatus according to claim 2 wherein said outer member of said main nozzle includes a peripheral rear edge and said central body member includes an annular seat therearound corresponding in size and shape to said rear edge of said outer member, and wherein said support ring seals the rear edge of said outer member to said seat when assembled.

4. The apparatus according to claim 1 wherein the end of said central body member opposite said outlet is enlarged and includes said plurality of auxiliary orifices therein, each of said auxiliary orifices comprises a cone-shaped recess at the rear end thereof, each of said feed nozzles being mounted in said cone-shaped recess and including an annular channel therearound, an opening in the wall of said central body member leading to each of said cone-shaped recesses for providing communication between a source of air and said channels, whereby air may be selectively introduced to each of said feed nozzles for drawing a selected yarn therethrough to said common orifice.

5. The apparatus according to claim 4 wherein said feed nozzles are separated one from the other and positioned around the axis of the central body member.

6. The apparatus according to claim 5 wherein each of said feed nozzles include a front portion thereof engaging the side walls of said funnel-shaped recess, and a plurality of slots extending longitudinally through said front portion for allowing air to pass from said annular channel into the adjacent one of said plurality of inlets.

7. The apparatus according to claim 6 wherein each of said feed nozzles includes an opening passing longitudinally therethrough through which the corresponding yarn is fed.

* * * * *